United States Patent [19]

Bowden et al.

[11] 4,221,357

[45] Sep. 9, 1980

[54] TIE ROD ASSEMBLY FOR CONCRETE FORM PANELS

[75] Inventors: George F. Bowden, Milford, Mich.; Warren W. Grist, Universal City; Ramon J. Cook, San Antonio, both of Tex.

[73] Assignee: The Burke Company, San Mateo, Calif.

[21] Appl. No.: 346

[22] Filed: Jan. 2, 1979

[51] Int. Cl.[2] ..... E04G 17/08; E04G 11/06

[52] U.S. Cl. ..... 249/191; 249/40; 249/45; 249/190; 249/219 R

[58] Field of Search ..... 249/191, 40, 46, 190, 249/216, 213, 219 R

[56] References Cited

U.S. PATENT DOCUMENTS

| | | | |
|---|---|---|---|
| 1,680,923 | 8/1928 | Williams | 249/219 R |
| 1,682,740 | 9/1928 | Colt | 249/219 R |
| 2,726,432 | 12/1955 | Lemma | 249/219 R |
| 3,690,613 | 9/1972 | Shoemaker | 249/40 |
| 3,910,546 | 10/1975 | Connors | 249/216 |
| 3,965,542 | 6/1976 | Gregory | 249/219 R |

*Primary Examiner*—Donald J. Arnold

*Attorney, Agent, or Firm*—Naylor, Neal & Uilkema

[57] ABSTRACT

A tie rod assembly to secure form panel elements in edge to edge engagement and tie opposed panels made of such elements in spaced apart relationship. The assembly employs a tie rod having a length less than the distance between the opposed panels and gripper mechanisms releasably engageable with the ends of the tie rod and proportioned for extension through tie rod openings formed in the panels. Key elements are engageable with the gripper mechanisms and the panel elements to lock the mechanisms in engagement with the rod and secure the panel elements in place. The rod is provided with enlarged heads at either end thereof for engagement by the gripper mechanisms and, in a preferred embodiment, the sides of the head are flattened.

15 Claims, 9 Drawing Figures

FIG. 7.
FIG. 5.
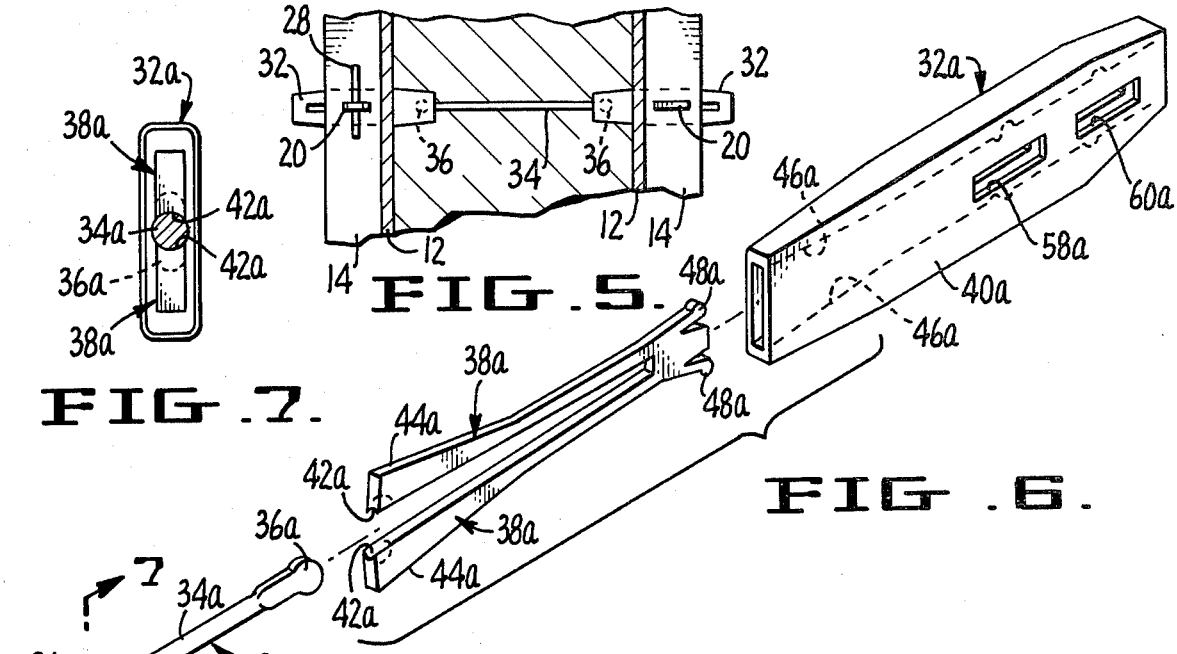
FIG. 6.
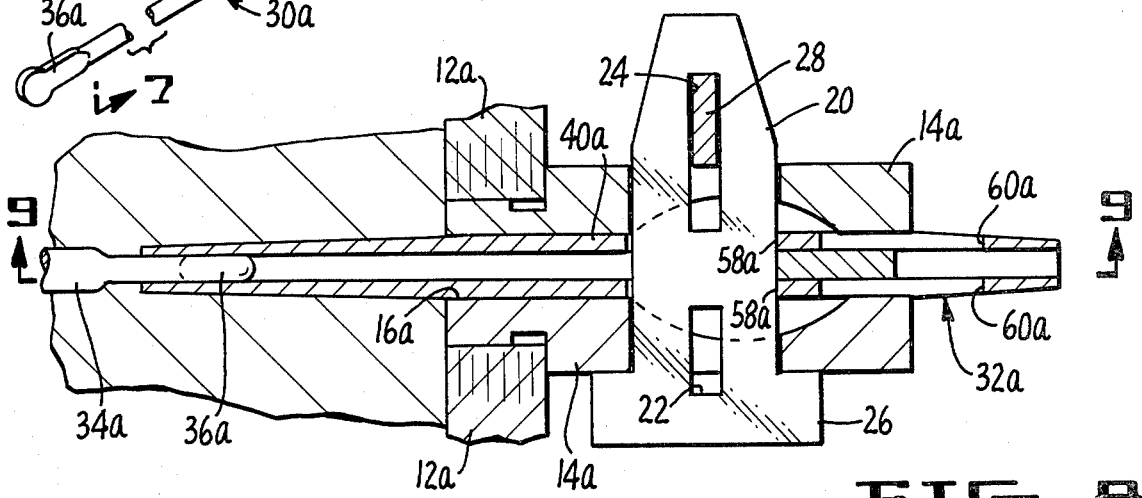
FIG. 8.
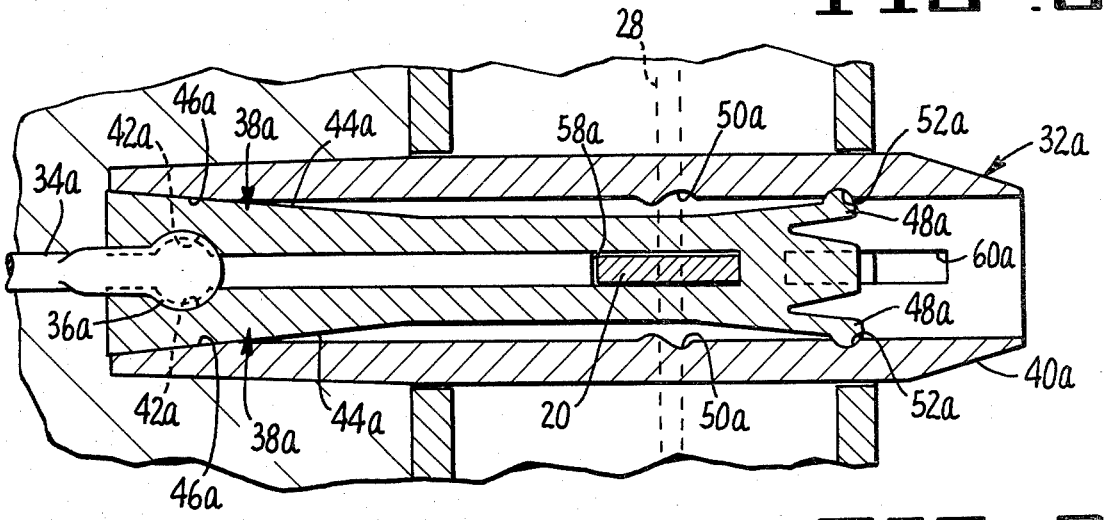
FIG. 9.

TIE ROD ASSEMBLY FOR CONCRETE FORM PANELS

BACKGROUND OF THE INVENTION

The present invention relates to a form panel system for forming concrete walls and the like and, more particularly, is directed to such a system employing an improved tie rod assembly for securing modular form panels in place. The invention is especially concerned with an assembly wherein the tie rods are of a length less than the distance between opposed form panels and the tie rod assembly may be fed into place through the panels.

In most conventional tie rod assemblies for securing form panels in opposed spaced relationship, the tie rods have a length greater than the distance between the panels and some type of gripper is employed to grip the ends of the tie rods externally of the concrete. In such systems, the tie rods may be of the "snap-tie" or "she-bolt" type and, after the concrete has set, the ends of the rods are either broken off or unscrewed somewhere inside the concrete.

The prior art also teaches the use of tie rods having a length less than the distance between opposed form panels. Such teachings may be found in U.S. Pat. Nos. 871,390; 2,726,432; and 3,965,542. The tie rods and the gripping assemblies therefor shown in these patents are not, however, facilitated for "feed-through" placement from one side of the form panels in the manner of the present invention.

The present invention is also concerned with an arrangement for securing adjacent modular form panel elements in edge to edge engagement. This is achieved by employing the tie rod gripping assembly as part of the structure to secure the elements together. U.S. Pat. No. 3,910,546 discloses a structure for securing adjacent form panel elements in edge to edge engagement, but in the structure of this patent the securing means is separate from the tie rod engaging mechanism.

SUMMARY OF THE INVENTION

The tie rod assembly of the invention comprises a rod and a gripper mechanism engaged with the rod and proportioned for slidable extension in its entirety through a tie rod opening in a form panel. The mechanism comprises a pair of jaws engageable with the rod and a housing extending around the jaws in slidable engagement therewith for movement between a first position locking the jaws in engagement with the head and a second position releasing the jaws from such engagement. The housing has a passage extending therethrough for receipt of a key which locks the housing in the first position and also functions to secure the housing to a form panel with which the assembly is used.

In a preferred embodiment, the tie rod is formed with an elongate central portion having an enlarged head at either end thereof. In another preferred embodiment each head has an expanded vertical dimension greater than the vertical cross-sectional dimension of the central portion and a reduced horizontal dimension equal to or less than the horizontal cross-sectional dimension of the central portion. The latter rod configuration enables the employment of a gripper mechanism of reduced thickness and also may be employed to retain the mechanism in a fixed rotational orientation relative to the rod.

A principal object of the invention is to provide an improved tie rod assembly for securing concrete form panels in opposed spaced relationship, which assembly employs a tie rod having a length less than the distance between the panels.

Another and related object of the invention is to provide such an assembly wherein it is not necessary to break the ends of the tie rod after use.

A further object of the invention is to provide an improved gripper mechanism for engaging the end of a tie rod, which mechanism is proportioned for slidable extension in its entirety through a tie rod opening provided in a form panel.

Still another object of the invention is to provide a tie rod assembly wherein the rod gripping mechanism is secured in place through means of a key lock having means to secure adjacent panel elements to edge to edge engagement.

Yet another object of the invention is to provide a gripper mechanism which forms a clean void in the surface of the concrete structure being formed.

Yet another object related to the latter object is to provide a mechanism for forming such a void wherein the end of a tie rod is disposed within the void for attachment of a plug element thereto.

Still another object of the invention is to provide an improved tie rod having an enlarged end thereon of a flattened configuration whereby the gripper mechanism employed with the rod may have a reduced thickness and be held against rotation relative to the rod.

A further object of the invention is to provide a gripper mechanism for an enlarged head on a tie rod wherein the mechanism employs jaws engageable with the head and detents are provided to releasably secure the jaws in either a condition engaged or released relative to the head.

Yet another object of the invention is to provide a gripper mechanism wherein a wedge may be employed to force the mechanism to a released condition.

The foregoing and other objects will become more apparent when viewed in conjunction with the accompanying drawings and following detailed description.

BRIEF DESCRIPTION OF THE DRAWINGS

FIG. 5 is an elevational view, with parts thereof shown in section, illustrating a pair of forms secured in opposed relationship by the assembly of the first embodiment;

FIG. 6 is an exploded perspective view of a second embodiment of the tie rod assembly;

FIG. 7 is a cross-sectional view taken on the plane designated by line 7—7 of FIG. 6;

FIG. 8 is a cross-sectional top plan view of the second embodiment assembly, as it would appear when secured in place on a form panel; and FIG. 9 is a cross-sectional view taken on the plane designated by line 9—9 of FIG. 8.

DESCRIPTION OF THE PREFERRED EMBODIMENTS

The First Embodiment

Figure 1:
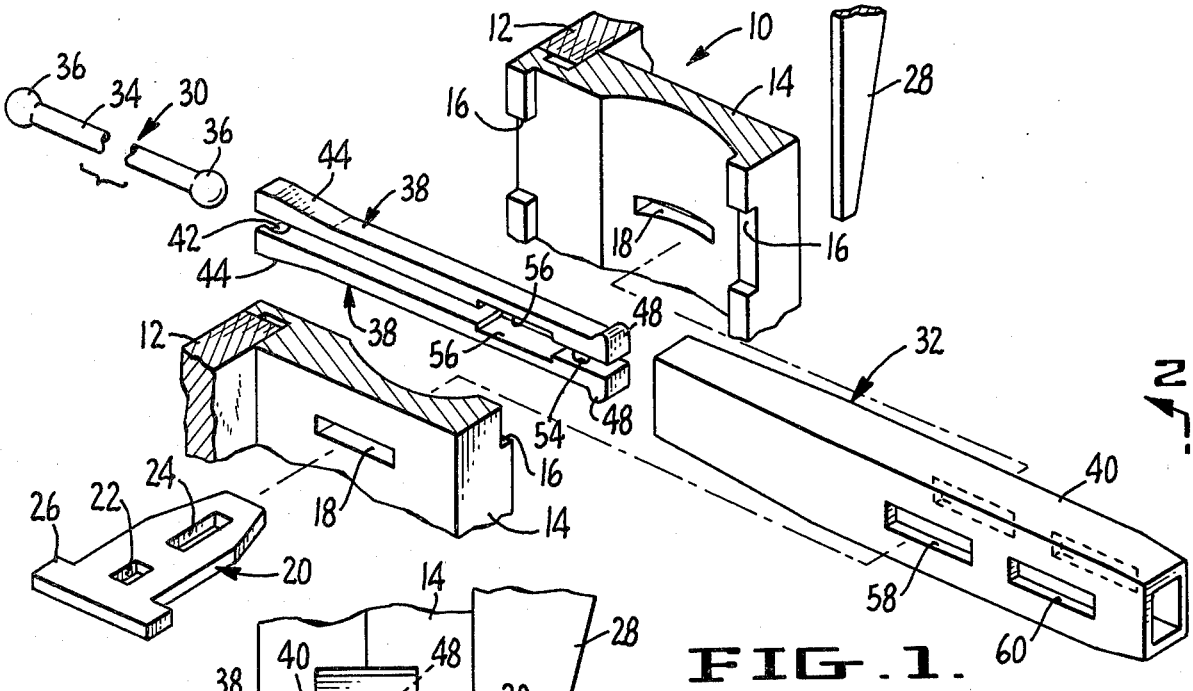
FIG. 1 is an exploded perspective view of a first embodiment of the tie rod assembly and a pair of modular form panel elements associated therewith.
Figure 2:
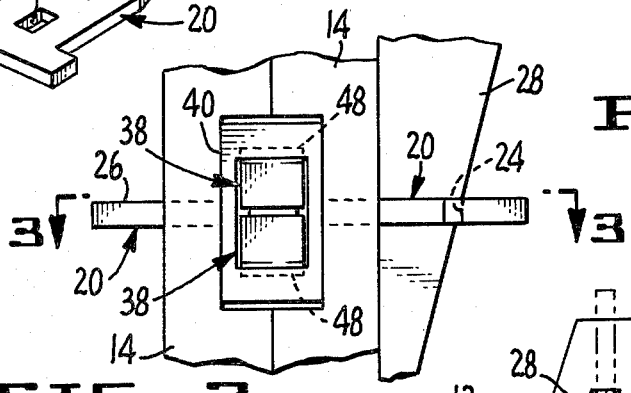
FIG. 2 is a cross-sectional view taken on the plane designated by line 2—2 of FIG. 1.

FIG. 1 illustrates a form panel 10 comprised of modular panel elements 12 having side rails 14 secured to the edges thereof. The rails 14 are of extruded construction and formed with notches 16 which define tie rod openings extending through the panel when the panel elements are secured in edge to edge engagement. The respective rails are also formed with aligned slots 18 extending transversely therethrough for the receipt of a key 20.

The key 20 has slots 22 and 24 extending therethrough and a head 26 at one end thereof. When the panel elements are in edge to edge engagement and the key 20 is extended through the slots 18, the head 26 bears against the side rail of one of the panel elements and a wedge 28 is extended through the slot 24 to the outside of the side rail of the other of the panel elements. Thus, the key and wedge secure the panel elements in aligned edge to edge engagement.

The tie rod assembly shown in FIG. 1 is made up of a tie rod 30 and a gripper mechanism 32. The rod 30 is formed with an elongate central portion 34 of circular cross-section having enlarged generally spherical heads 36 at either end thereof. In the preferred embodiment, the rod is fabricated of carbon steel and the heads are formed thereon by a cold "buttonhead" forming process.

The gripper mechanism 32 comprises a pair of elongate chuck jaws 38 slidably received within a tubular housing 40. As can be seen from FIG. 4, the jaws are formed with opposed hemispherical sockets 42 for receipt of the head 36 of a rod. The sides of the jaws opposite the sockets 42 are formed with outwardly inclined surfaces 44 disposed for camming engagement with complemental surfaces 46 formed on the inside of the housing 40. The ends of the jaws opposite the sockets 42 are formed with detent protrusions 48 engageable in detent grooves 50 and 52 formed in the inside of the housing. A resilient member 54 in the form of an elastomeric plug is captured between opposed sockets formed in the jaws, and functions to resiliently spread the jaws so that the protrusions 48 snap into the grooves 50 and 52 when in apposition thereto.

Figure 4:
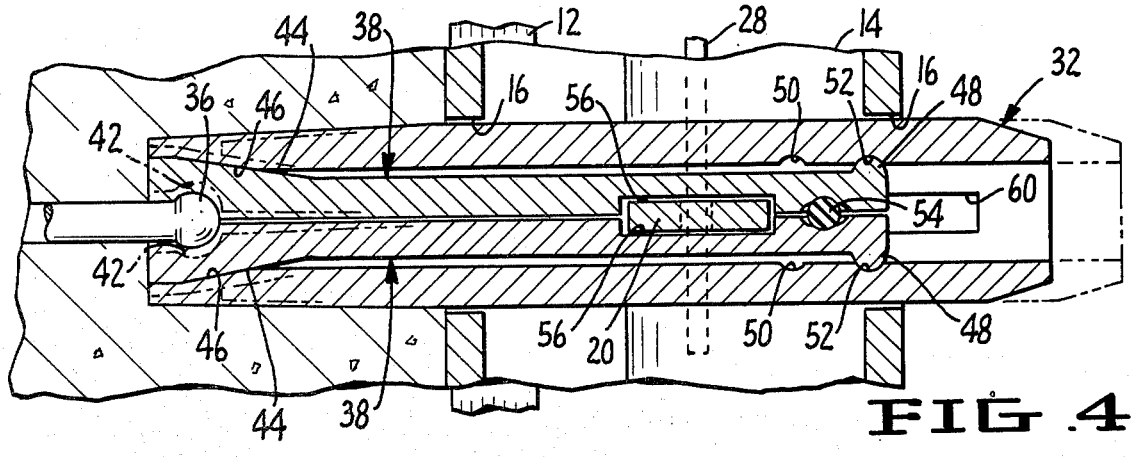
FIG. 4 is a cross-sectional view taken on the plane designated by line 4—4 of FIG. 3.

When the jaws are fully retracted into the housing, as shown in FIG. 4, the jaws securely engage the head 36 of a rod engaged therebetween and the protrusions 48 and grooves 52 function to releasably secure the jaws in this condition. The assembly thus provided is stiff and ideally suited for sliding through the tie openings in the forms. Movement of the housing to a position wherein the protrusions 48 are engaged in the grooves 50 functions to release the jaws so that the head of the rod 36 engaged thereby may be removed (see FIG. 4).

Figure 3:
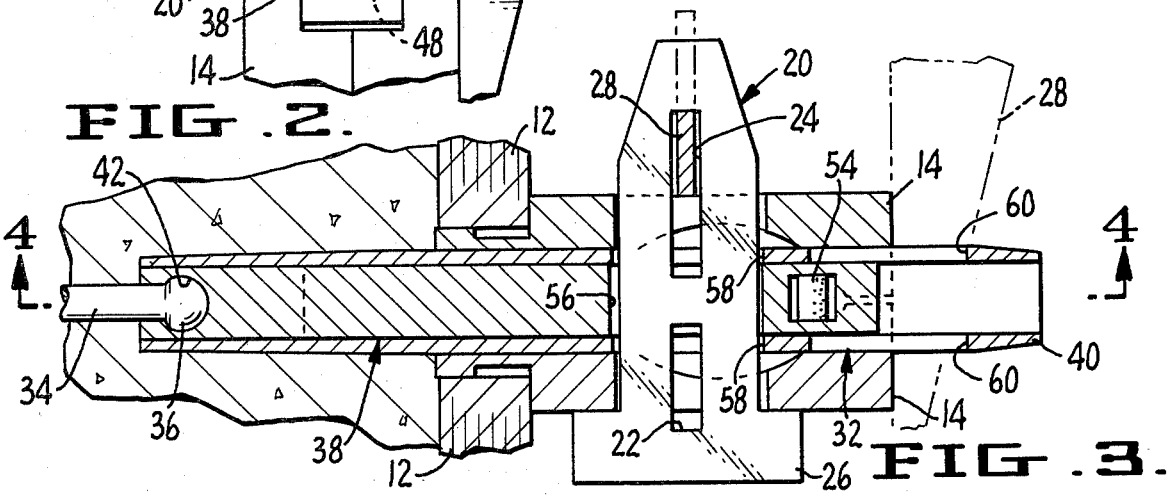
FIG. 3 is a cross-sectional view taken on the plane designated by line 3—3 of FIG. 2.

The basic structure of the jaws 38 is completed by a pair of opposed grooves 56 formed therein for receipt of the key 20. Slots 58 in the housing 40 align with the grooves 56 when the jaws are in the fully retracted engaged condition, as shown in FIGS. 3 and 4. With the grooves 56 and slots 58 so aligned, the key 20 may be passed through the gripper mechanism to lock the jaws 38 in engagement with the head of a rod and secure the mechanism in locked condition between the rails 14.

The housing 40 is also provided with a pair of aligned slots 60 disposed so as to be intersected by a plane defined by the inner ends of the jaws 38 when the jaws are fully drawn into the housing. When it is desired to release the jaws from the engaged condition, the wedge 28 is removed from the key 20 and the key 20 is then removed from the slots 58. With the key so removed, the wedge 28 may then be passed through the slots 60 so as to engage the outside ends of the slots and strip the housing to a position releasing the jaws from engagement with the head of a tie rod (see the phantom line illustration of the housing in FIG. 4).

The Second Embodiment

The second embodiment differs from the first embodiment primarily in the following respects: the tie rod has flattened sides to accommodate a thinner gripper mechanism and provide for securement of the mechanism against rotation relative to the rod; the gripper jaws are integral with one another; and, the body of the jaw element functions to normally bias the jaws toward a disengaged condition, without the interdisposition of a separate resilient biasing element.

Referring now to FIG. 6, the gripper mechanism therein is designated by the numeral 32*a* and comprises integrally formed chuck jaws 38*a* slidably received within a housing 40*a*. The jaws 38*a* are formed with semicircular sockets 42*a* for receipt of the head of a tie rod and outwardly inclined surfaces 44*a* engageable with complimental surfaces 46*a* formed in the housing 40*a*. The ends of the jaws opposite the sockets 42*a* are formed with detent protrusions 48*a* releasably engageable in detent grooves 50*a* and 52*a* formed in the housing. The housing is formed with slots 58*a* and 60*a* corresponding, respectively, to the slots 58 and 60 of the FIG. 1 embodiment.

The tie rod of the second embodiment is designated by the numeral 30*a* and comprises an elongated central portion 34*a* of circular cross-section having enlarged heads 36*a* at either end thereof formed with rounded upper and lower surfaces and flattened side surfaces. The side surfaces merge into the central portion 34*a* and have a horizontal dimension (width) somewhat less than the cross-sectional dimension of the central portion 34*a*. The vertical extent of the head, as defined by the upper and lower rounded surfaces thereof, has a vertical dimension greater than the cross-sectional dimension of the central portion 34*a*.

When the tie rod 34*a* is engaged by the gripper mechanism 32*a*, as shown in FIGS. 8 and 9, the vertical side walls of the housing 40*a* slidably engage the flat side surfaces of the head 36*a* to secure the gripper mechanism against rotation relative to the rod. The latter relationship can be seen from FIG. 8.

The form panel elements 12*a* and cooperating side rails 14*a* of the second embodiment correspond to those of the first embodiment, with the exception that the grooves 16*a* in the rails are of a depth less than the depth of the grooves 16 in order to accommodate the reduced thickness of the gripper mechanism 32*a*. The key and wedge elements of the second embodiment, designated 20 and 28, respectively, are identical to those of the first embodiment. These elements function in the same manner as those of the first embodiment. To lock the gripper mechanism 32*a*, the key 20 is extended through the slots 58*a* in apposition to the bight portion between the jaws 38*a*. To release the mechanism, the key 20 is removed from the slots 58*a* and the wedge 28 is forced through the slots 60*a* to strip the housing 40*a* back relative to the jaws 38*a*.

SUMMARY OF OPERATION

The first and second embodiments operate in essentially the same manner. In this operation, a pair of form panels, each of which panels is comprised of at least two panel elements, is erected and held in place with the panels in aligned apposition. The tie rod assemblies are then fed through the aligned tie rod openings in the opposed panels from the outside of one of the panels and secured in place through means of the key and wedge elements.

Placement of the tie rod assemblies from one side of the opposed form panels is possible because the assemblies may be fed completely through the tie rod openings. This "feed-through" operation is facilitated by the tapered outer surfaces at either end of each of the gripper mechanism housings.

Once the tie rod assemblies are secured in place, concrete is poured between the form panels and permitted to set. After adequate setting of the concrete, the keys 20 are removed and the gripper mechanisms are released from the tie rods embedded in the concrete by driving the wedges 28 through the gripper mechanisms. The latter operation functions to strip the housings back on the jaws and provide a void in the concrete into which the jaws may move to release the rods. After the gripper mechanisms are released, the form panels and mechanisms may be removed and reused.

In a wall formed by the above-described operation, the tie rods remain embedded in the wall and sockets are formed in the wall and communicate with the ends of the rods. These sockets have a tapered configuration corresponding to the tapered configuration of the inner ends of the gripper mechanism housings. The sockets may be readily covered by grout or a suitable plug and the ends of the tie rods within the sockets may be employed to secure the grout or plugs in place. The ends of the rods may also be used as anchors to which other hardware (e.g., overlapping forms or scaffolds) can be attached.

Conclusion

From the foregoing description, it is believed apparent that the invention enables the attainment of the objects initially set forth herein. It should be understood, however, that the invention is not intended to be limited to the specifics of the illustrated embodiments. For example, it is anticipated that the tie rod assembly may find use in environments other than that where form panels are secured in opposed spaced relationship. In such environments one end of the rod could be anchored to a pre-existing formation (e.g., by a rock anchor) and the other end provided with the head and gripper assembly of the present invention.

What is claimed is:

1. In combination with a concrete form panel having at least one tie rod opening extending therethrough, an improved tie rod assembly for securing said panel in place, said assembly comprising: a tie rod having a head on at least one end thereof; a pair of gripper jaws releasably engaged with the head; a housing extending around the jaws in slidable engagement therewith for movement relative to said jaws from a first position holding said jaws in engagement with said head to a second position releasing said jaws from such engagement, said housing extending longitudinally of the rod and being proportioned for slidable extension in its entirety through the opening in the form panel; locking means extensible transversely through the housing for engagement with the housing and jaws to positively lock the housing in the first position and secure the housing to the panel; and, release means extensible transversely through the housing to move the housing to the second position.

2. In a combination according to claim 1, the improved assembly wherein: the locking means comprises a key extensible transversely through the housing to lock the jaws in the first position; and, the release means comprises a wedge transversely extensible through the housing to force the jaws to the second position.

3. In a combination according to claim 1 wherein the form panel comprises a pair of panel elements disposed in edge to edge engagement with one another and the tie rod opening intersects the engaged edges of the elements, the improved assembly wherein: the locking means comprises a key extensible transversely through the housing and edge portions of the panel elements to lock the jaws in the first position and secure the elements against separation from one another.

4. In a combination according to claim 1, the improved assembly wherein: the tie rod and head are formed with flattened side portions; and the housing has side walls disposed for engagement with said portions to secure the jaws and housing against rotation relative to the rod when the jaws are engaged with the head of the rod.

5. In a combination according to claim 1, the improved assembly wherein the jaws extend longitudinally through the housing opposition to one another, the improved assembly further comprising: resilient means to normally bias said jaws apart; complimentally engageable cam surfaces on the jaws and housing to force said jaws towards one another against the influence of said biasing means in response to movement of the housing from the second position to the first position; and, mutually engageable detent means on the jaws and housing to releasably secure the jaws at select longitudinally adjusted positions relative to the housing.

6. In a combination according to claim 5, the improved assembly wherein: the jaws are separate from one another; the resilient means comprises a compression element received between the jaws; and the detents are held in engagement in response to the biasing action of the compression element.

7. In combination with a pair of concrete form panels having aligned tie rod openings extending therethrough, an improved assembly for securing said panels in spaced relationship to one another, said assembly comprising: rail elements secured to the outside of said panels adjacent the tie rod openings; a tie rod having a length less than the distance said panels are spaced when secured in spaced relationship; a pair of grippers releasably engaged, respectively, with either end of the rod and extending longitudinally of the rod, said grippers being proportioned for slidable extension in their entirety through the tie rod openings and each having a housing with jaw means therein, said housing extending around the jaw means for movement relative thereto from a first position locking the jaw means in engagement with the rod to a second position releasing the jaw means from such engagement; key elements extensible transversely through the grippers and the rail elements adjacent the openings to selectively lock the grippers against movement relative to the panels and positively lock the housing in the first position.

8. In a combination according to claim 7 wherein each form panel comprises a pair of panel elements disposed in edge to edge engagement with one another, the tie rod openings intersect the engaged edges of the panels and the rail elements comprise rails secured to the respective panels adjacent the engaged edges thereof, the improved assembly wherein: the key elements are extensible through the rails to secure the panel elements against separation from one another.

9. In a combination according to claim 8, the improved assembly wherein each key element is of elongated configuration and has an enlarged head at one end thereof for abutting engagement with the rail to one side of the gripper through which the element extends and a removable locking wedge extending through the other end thereof for abutting engagement with the rail to the other side of the gripper through which the element extends.

10. In a combination according to claim 7, the improvement wherein: heads with flattened side portions are formed at either end of the tie rod and the grippers are engageable with said portions for securement against rotation relative to the rod.

11. In combination with a concrete form panel comprised of two panel elements disposed in edge to edge engagement with one another and having a tie rod opening intersecting the engaged edges of the elements, an improved tie rod assembly for securing said panel elements in place and in edge to edge engagement, said assembly comprising: a tie rod; a pair of gripper jaws engaged with one end of the rod; a housing extending around the jaws in slidable engagement therewith for movement relative to said jaws between a first position locking the jaws in engagement with the rod and a second position releasing the jaws from such engagement, said housing being proportioned for slidable extension in its entirety through the opening in the form panel and having first and second passages extending transversely therethrough; a locking key extensible through said first opening to positively lock the housing in the first position, said key having a head at one end thereof for engagement with one of the panel elements and an opening in the other end thereof for receipt of a wedge; and, a wedge received in the opening in the key and engaged with the other of the panel elements whereby said key retains said elements in edge to edge engagement, said wedge being removable from the key to permit removal of the key from the first opening of the housing and being insertable into the second opening of the housing to force the housing to the second position when the key is removed from the first opening.

12. In a combination according to claim 11, the improved assembly wherein the ends of the housing are of a converging configuration to facilitate the passage of the housing through the opening in the form panel.

13. A tie rod for securing a pair of concrete form panels in opposed spaced apart relationship, said rod being of a length less than the distance by which the panels are spaced and comprising: an elongate central portion and an enlarged head formed at either end of the central portion, each head having an expanded vertical dimension greater than the vertical cross-sectional dimension of the central portion of the rod and a reduced horizontal dimension equal to or less than horizontal cross-sectional dimension of the central portion of the rod.

14. A tie rod according to claim 13 wherein: the central portion of the rod is of a circular cross-section and the heads have generally flat vertically extending side surfaces and rounded top and bottom surfaces.

15. A tie rod according to claim 14 wherein the central portion of the rod has generally flat vertically extending side surfaces adjacent the heads and coextensive with the side surfaces thereof.

* * * * *